US006276458B1

(12) United States Patent
Malone et al.

(10) Patent No.: US 6,276,458 B1
(45) Date of Patent: Aug. 21, 2001

(54) APPARATUS AND METHOD FOR CONTROLLING FLUID FLOW

(75) Inventors: David L. Malone, Sugar Land; Ronald E. Pringle, Houston, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/346,265

(22) Filed: Jul. 1, 1999

Related U.S. Application Data

(63) Continuation-in-part of application No. 09/243,401, filed on Feb. 1, 1999.

(51) Int. Cl.[7] ..... E21B 34/06

(52) U.S. Cl. ..... 166/386; 166/240; 166/320; 251/205

(58) Field of Search ..... 166/386, 320, 166/321, 316, 240; 251/205, 121

(56) References Cited

U.S. PATENT DOCUMENTS

| | | | | |
|---|---|---|---|---|
| 2,537,066 | | 1/1951 | Lewis . | |
| 2,696,362 | * | 12/1954 | Craig et al. | 251/205 |
| 2,723,677 | | 11/1955 | Middleton et al. . | |
| 2,769,610 | * | 12/1991 | Franzheim | 251/205 |
| 2,815,925 | | 12/1957 | Fisher, Jr. . | |
| 4,006,919 | * | 2/1977 | Neuman | 280/736 |
| 4,403,659 | * | 9/1983 | Upchurch | 166/374 |
| 5,072,599 | * | 12/1991 | Simone | 62/308 |
| 5,156,207 | * | 10/1992 | Haugen et al. | 166/142 |
| 5,156,220 | | 10/1992 | Forehand et al. . | |
| 5,211,241 | * | 5/1993 | Mashaw, Jr. et al. | 166/332 |
| 5,309,993 | | 5/1994 | Coon et al. . | |
| 5,316,084 | | 5/1994 | Murray et al. . | |
| 5,368,276 | * | 11/1994 | Pfeiffer | 251/205 |
| 5,529,126 | * | 6/1996 | Edwards | 166/331 |
| 5,603,385 | | 2/1997 | Colebrook . | |
| 5,921,528 | * | 7/1999 | McCray | 251/205 |
| 5,979,558 | * | 11/1999 | Bouldin et al. | 166/363 |

* cited by examiner

*Primary Examiner*—Hoang Dang
(74) *Attorney, Agent, or Firm*—Trop, Pruner & Hu P.C.

(57) ABSTRACT

A choke system or valve assembly includes a valve having an orifice through which fluid flow can be choked or controlled. An actuator is adapted to position the valve at one or more incremental positions between an open position and a closed position. The valve, orifice, and actuator may be adapted to provide a substantially consistent (or otherwise predetermined) change in pressure drop and flow rate between different valve positions. This is accomplished by varying the flow area of the valve orifice non-linearly as the valve is shifted or stepped through the several valve positions. Another feature is the ability of the actuator in conjunction with an indexing mechanism to provide substantially precise control of the valve orifice through the several valve positions. The indexing mechanism is separated into two portions: an indexer device to index the actuator through the several valve positions; and a positioner device to maintain the valve at a fixed position after the actuator has shifted the valve to the next incremental position.

30 Claims, 11 Drawing Sheets

APPARATUS AND METHOD FOR CONTROLLING FLUID FLOW

This is a continuation-in-part of U.S. patent application Ser. No. 09/243,401, entitled "Valves for Use in Wells", filed Feb. 1, 1999.

BACKGROUND OF THE INVENTION

1. Field of Invention

The present invention relates to the field of downhole well tools. More specifically, the invention relates to a device and method for controlling downhole valves to obtain the desired flow characteristics through the valves.

2. Related Art

The economic climate of the petroleum industry demands that oil companies continually improve their recovery systems to produce oil and gas more efficiently and economically from sources that are continually more difficult to exploit and without increasing the cost to the consumer. One successful technique currently employed is the drilling of horizontal, deviated, and multilateral wells, in which a number of deviated wells are drilled from a main borehole. In such wells, as well as in standard vertical or near-vertical wells, the wellbore may pass through various hydrocarbon bearing zones or may extend through a single zone for a long distance. One manner to increase the production of the well is to perforate the well in a number of different locations, either in the same hydrocarbon bearing zone or in different hydrocarbon bearing zones, and thereby increase the flow of hydrocarbons into the well.

One problem associated with producing from a well in this manner relates to the control of the flow of fluids from the well and to the management of the reservoir. For example, in a well producing from a number of separate zones, or lateral branches in a multilateral well, in which one zone has a higher pressure than another zone, the higher pressure zone may produce into the lower pressure zone rather than to the surface. Similarly, in a horizontal well that extends through a single zone, perforations near the "heel" of the well—nearer the surface—may begin to produce water before those perforations near the "toe" of the well. The production of water near the heel reduces the overall production from the well. Likewise, gas coning may reduce the overall production from the well.

A manner of alleviating such problems may be to insert a production tubing into the well, isolate each of the perforations or lateral branches with packers, and control the flow of fluids into or through the tubing. However, typical flow control systems provide for either on or off flow control with no provision for throttling of the flow. To fully control the reservoir and flow as needed to alleviate the above-described problems, the flow must be throttled. A number of devices have been developed or suggested to provide this throttling although each has certain drawbacks. Note that throttling may also be desired in wells having a single perforated production zone.

Specifically, the prior devices are typically either wireline retrievable valves, such as those that are set within the side pocket of a mandrel, or tubing retrievable valves that are affixed to the tubing string. An example of a wireline retrievable valve is shown in U.S. patent application Ser. No. 08/912,150, by Ronald E. Pringle entitled "Variable Orifice Gas Lift Valve for High Flow Rates with Detachable Power Source and Method of Using Same" that was filed Aug. 15, 1997, and which is hereby incorporated herein by reference. The variable orifice valve shown in that application is selectively positionable in the offset bore of a side pocket mandrel and provides for variable flow control of fluids into the tubing.

A typical tubing retrievable valve is the standard "sliding sleeve" valve, although other types of valves such as ball valves, flapper valves, and the like may also be used. In a sliding sleeve valve, a sleeve having orifices radially therethrough is positioned in the tubing. The sleeve is movable between an open position, in which the sleeve orifices are aligned with orifices extending through the wall of the tubing to allow flow into the tubing, and a closed position, in which the orifices are not aligned and fluid cannot flow into the tubing.

Other types of downhole valves are numerous and include that shown in U.S. patent application Ser. No. 09/243,401, by David L. Malone, entitled "Valves for Use in Wells" that was filed Feb. 1, 1999, and U.S. patent application Ser. No. 09,325,474, entitled "Apparatus and Method for Controlling Fluid Flow in a Wellbore", by Ronald E. Pringle et al., that was filed Jun. 3, 1999, now U.S. Pat. No. 6,227,302 and which are hereby incorporated herein by reference. In general, the valve has valve covers that provide a seal around the periphery of the cover and the orifice through the tubing. The valve covers are sized in accordance with the size of the orifice. In this way, the surface of contact between the cover and the tubing, or seat, is much less than that encountered with a sliding sleeve and the stroke length is decreased. Additionally, the valve uses low coefficient of friction material, such as a polycrystalline diamond coating, to facilitate sliding and incorporates a self-cleaning feature aimed at removing built up debris that tends to impede valve movement.

Electric and hydraulic remote actuators for the downhole valves have been developed to overcome certain other difficulties often encountered with operating the valves in horizontal wells, highly deviated wells, and subsea wells using slickline or coiled tubing to actuate the valve. The remote actuators are positioned in the well proximal the valve to control the throttle position of the valve.

One problem associated with hydraulic type actuators relates to the limitations imposed by the incremental steps employed with such systems. Electrical actuators may be positioned at virtually any selected position between open and closed positions because of the flexibility of the motors. However, hydraulic actuators typically use indexing mechanisms to position the valves at incremental positions at and between open and closed positions. The number of increments between the open and closed positions may be relatively limited due to space and other limitations, with an example mechanism having six positions. In conventional indexing mechanisms, the distance between increments is generally equal. Further, the orifices provided in the valves are typically circular or otherwise generally uniform in shape. In one example arrangement, the first position is the closed position, the second incremental position opens the valve twenty percent, the third incremental position opens the valve forty percent, the fourth incremental position opens the valve sixty percent, the fifth incremental position opens the valve eighty percent, and the sixth position fully opens the valve.

The evenly spaced increments and the generally uniform hole sizes may raise several issues. The pressure drop across a valve is proportional to the inverse of the area squared. Therefore, a valve orifice in which the area at each increment varies generally linearly produces a change in the pressure drop and the flow rate that varies widely, with the pressure drop and flow rate change being greater when the valve is initially being opened as compared to the pressure drop and flow rate change due to the valve going from a nearly fully open position to the fully open position. For example, in the example mentioned above, the difference in the pressure drop (and flow rate) change between the twenty percent open and forty percent open conditions is much greater than that between the sixty percent open and eighty percent open conditions. One of the key design considerations and uses for a downhole valve is the control of the pressure drop and flow rate. Thus, there remains a need for a valve and control system that provides for improved pressure drop and flow rate characteristics as the valve is being stepped through incremental positions.

Further, when using an incremental system, a target pressure drop or valve position may fall between increments. Thus, if the valve positions are spaced apart so that a target position falls in between existing choke positions, the choke actuator may continually shift between adjacent positions in attempting to achieve the target flow conditions. Such a condition may occur between, for example, the 20% and 40% incremental positions wherein the change in flow rate and pressure drop is relatively large. Continual shifting may tend to wear the downhole components without providing the desired flow. Consequently, there is a need for a valve and control system adapted to provide the incremental positions necessary to avoid continual shifting and to meet the most likely flow needs for the valve.

Another limitation associated with some conventional valve actuators is that indexing mechanisms to step the actuators through incremental positions do not provide precise control. Thus, for example, when an actuator is indexing from a first incremental position to a second incremental position, the actuator may actually cause the valve to temporarily open past the second incremental position due to the design of the indexing mechanism. As a result, a surge in fluid flow may be caused by the temporary overshoot of the actuator. Such a fluid surge may damage the surrounding formation or cause the production of contaminants such as sand. Thus, a need exists for a valve actuator having more precise control than available with conventional valve actuators.

SUMMARY

In general, according to one embodiment, a choke system includes a valve having an orifice through which fluid flow can be choked and an actuator adapted to position the valve at one or more incremental positions between an open position and a closed position. The valve, the orifice, and the actuator are adapted to provide a substantially consistent change in pressure drop between different valve positions.

In general, according to another embodiment, a valve assembly includes a valve and an actuator moveable to a plurality of positions to actuate the valve. A mechanism has an indexer device and a positioner device, and the indexer device is capable of cooperating with the actuator to step the actuator through the plurality of positions. The positioner device is adapted to maintain the position of at least a first portion of the actuator after each step of the actuator to provide substantially precise control of the valve.

Other features and embodiments will become apparent from the following description and from the claims.

BRIEF DESCRIPTION OF THE DRAWINGS

The manner in which these objectives and other desirable characteristics can be obtained is explained in the following description and attached drawings in which.

Figure 1:
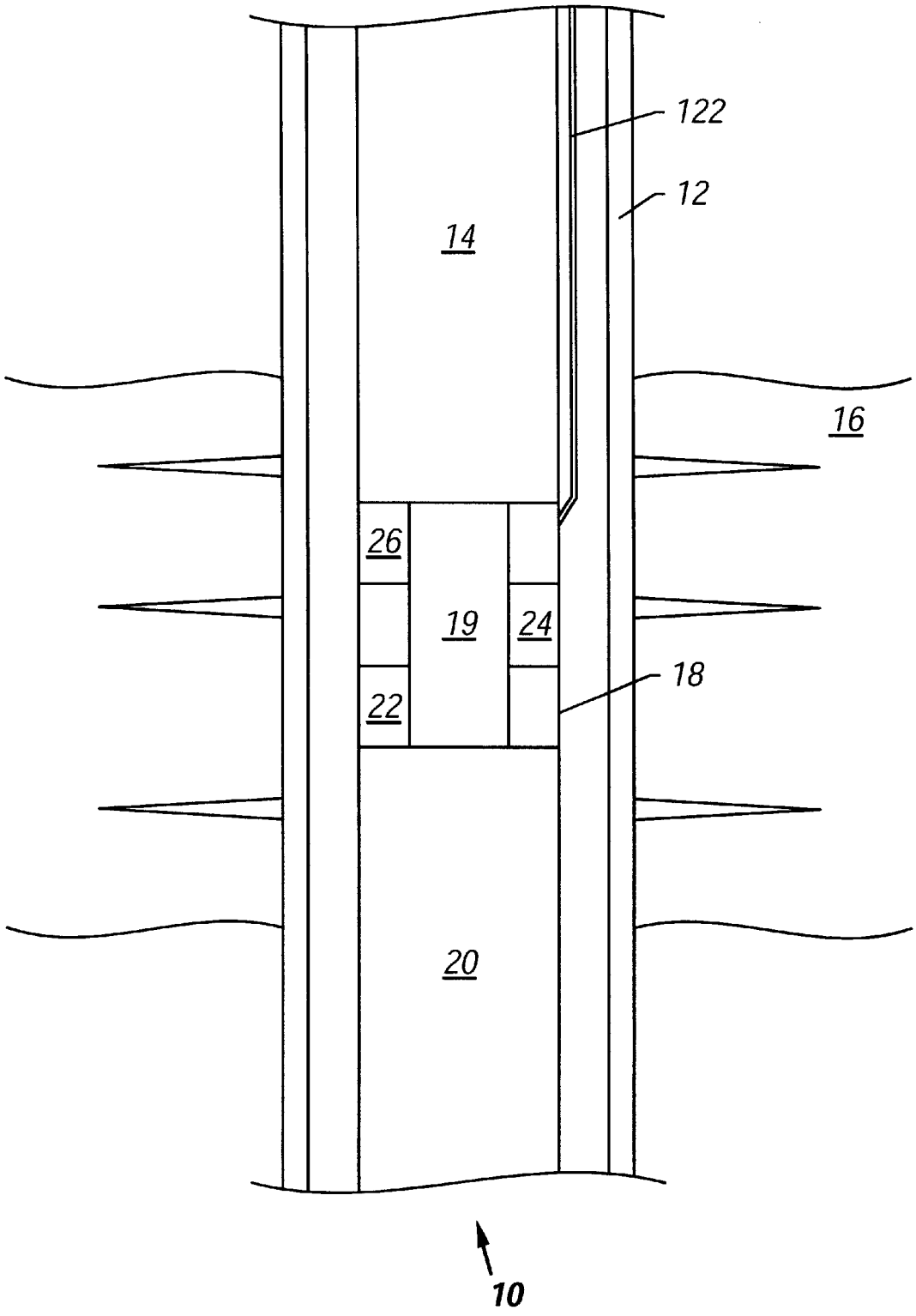
FIG. 1 illustrates exemplary downhole equipment including a choke system in accordance with one embodiment of the invention.

It is to be noted, however, that the appended drawings illustrate only some embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible. For example, although the following discussion primarily focuses on employing a hydraulic actuator, it is to be noted that other embodiments of the present invention may also be useful for other types of actuators, such as electric or mechanical actuators that use incremental positioning.

As used herein, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right or right to left relationship as appropriate.

Generally, some embodiments of the invention provide a choke system or valve assembly that includes a valve adapted to choke the flow through one or more orifices of the valve. A valve actuator operably attached to the valve is able to position the valve at one or more incremental positions between an open position and a closed position. The valve actuator defines a predefined shifting sequence to provide the incremental positions of the valve. The change in flow area as the valve is actuated through the incremental positions varies so that predetermined changes in flow condition can be provided. As used here, flow condition may refer to pressure drop across the valve and/or flow rate through an orifice in the valve. In one example, the change in flow condition of the valve through the several incremental positions can be made to be substantially the same. However, other predetermined changes in flow conditions can be achieved in other embodiments. In one embodiment, variation of the valve flow area is achieved by use of valve orifices having non-uniform shapes. In another embodiment, non-linear variations of flow area are achieved by varying stroke lengths of the valve actuator as it steps through its shifting sequence. An indexing mechanism is connected to the actuator to restrict motion of the valve actuator to provide the incremental positions between the open and closed positions. The indexing mechanism includes a first indexer member defining a plurality of elongated, spaced, interconnected slots and a second indexer member having an indexer detent attached thereto. The indexer detent is adapted to mate with and move within the plurality of slots. The first and second indexer members are adapted for movement relative to one another, with the plurality of slots and the indexer detent adapted to cooperatively restrict the relative movement of the first and second indexer members.

According to another feature of some embodiments, the indexing mechanism connected to the valve actuator provides substantially precise control in actuating the valve to incremental positions between open and closed positions. This may be accomplished by separating the indexing mechanism into two parts: an indexer device and a positioner device. The indexer device includes an indexer sleeve defining an indexing pattern about its circumference. The indexer sleeve is rotatable about a first mandrel segment of an operator mandrel in the valve actuator. The first mandrel segment is actuatable by fluid pressure to move up and down, which causes incremental rotation of the indexer sleeve about the first mandrel segment to provide indexing through the incremental positions of the valve. The positioner device includes a positioner sleeve that is mounted about a second mandrel segment of the operator mandrel. The positioner device defines a plurality of positions that correspond substantially precisely to the incremental positions of the valve. The first and second mandrel segments of the operator mandrel are operably attached with a lost-motion gap provided between the mandrel segments to allow the first mandrel segment to reset after each increment of the valve actuator without moving the second mandrel segment. Thus, the positioner device is able to precisely maintain the position of the second mandrel segment so that the valve is not actuated past a target incremental position of the valve.

Referring to FIG. 1, in one embodiment, a tubing section 14 extends inside a wellbore to a zone 16 (which may be production zone or an injection zone, for example) in a formation. The wellbore 10 is lined with casing 12, which is perforated to allow fluids to flow from, or be injected into, the zone 16. A choke system or valve assembly 18 according to one embodiment is attached to the lower end of the tubing section 14. The choke system 18 at its lower end may also be attached to another tubing section 20. Fluid to be produced from, or injected into, the zone 16 passes through the bore 19 of the choke system and a bore (not shown) in the tubing 14. The choke system 18 includes a valve 22 that may be incrementally set at and between open and closed positions to control fluid flow between a bore 19 of the choke system and the outside of the valve 22. Between the open and closed positions, the valve 22 may be set at one or more intermediate, incremental positions by a valve actuator 26 and indexing mechanism 24. In accordance with some embodiments, a feature of the valve actuator 26 is that the flow area of the valve between successive incremental positions may be controlled to vary non-linearly as the valve actuator 26 goes from a fully closed position to a fully open position to provide for predetermined changes in flow condition of the valve 22. Thus, for example, from a closed position to a first partially open position, the flow area through the valve 22 may increase by a first amount. The flow area between the first partially open position and a second partially open position may increase by a second amount that is different from the first amount. In this manner, opening of the valve 22 may be performed in incremental steps that correspond to non-linear increases in flow area of the valve 22. As a result, actuation of the valve 22 may be controlled so that the change in flow condition is substantially consistent, for example, as the valve 22 is actuated between the several incremental positions (including the open and closed positions). Any other predetermined change in flow condition can also be achieved with further embodiments.

In one embodiment, the valve orifice is openable in a lengthwise direction and has a width generally transverse to the lengthwise direction. The width of the orifice generally increases form a first end, proximal the first closed position, to a second end, proximal the open position.

In further embodiments, the width of the orifice can be increased and decreased to provide the desired flow condition change characteristic.

Another feature of some embodiments of the choke system 18 is that the indexing mechanism 24 provides substantially precise control of the incremental steps made by the valve actuator 26 in opening the valve 22. This prevents surges from occurring through the valve 22 due to it opening more than it should and than falling back to the target incremental position. Such surges of flow from the surrounding formation into the valve 22 may cause damage to the formation. Further, surges in fluid flow may cause sand or other contaminants to be produced from the surrounding formation, which is undesirable.

Figure 2A:
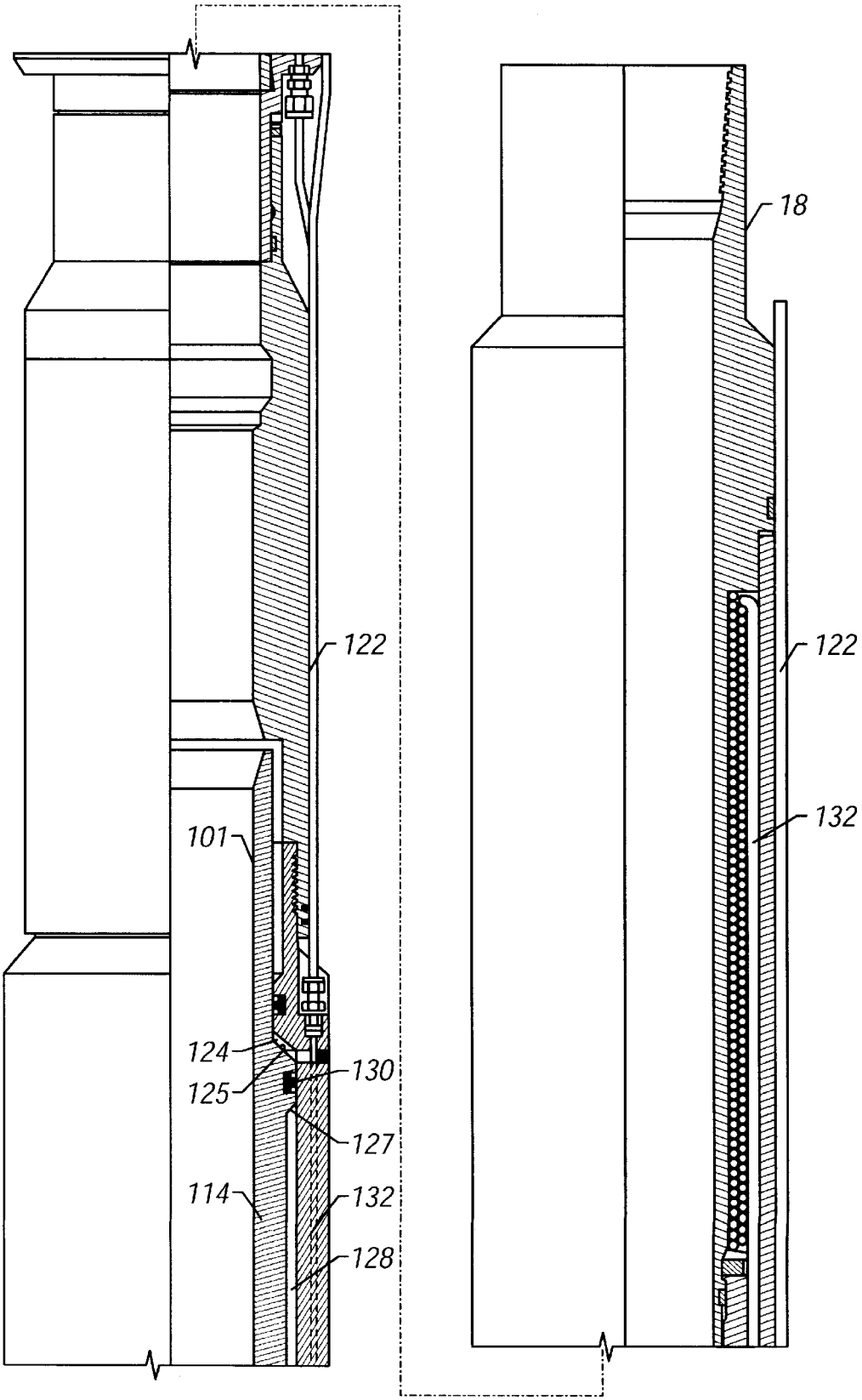
FIGS. 2A–2C are a cross-sectional view of the choke system of FIG. 1 that includes an actuator, indexing mechanism, and valve.
Figure 2B:
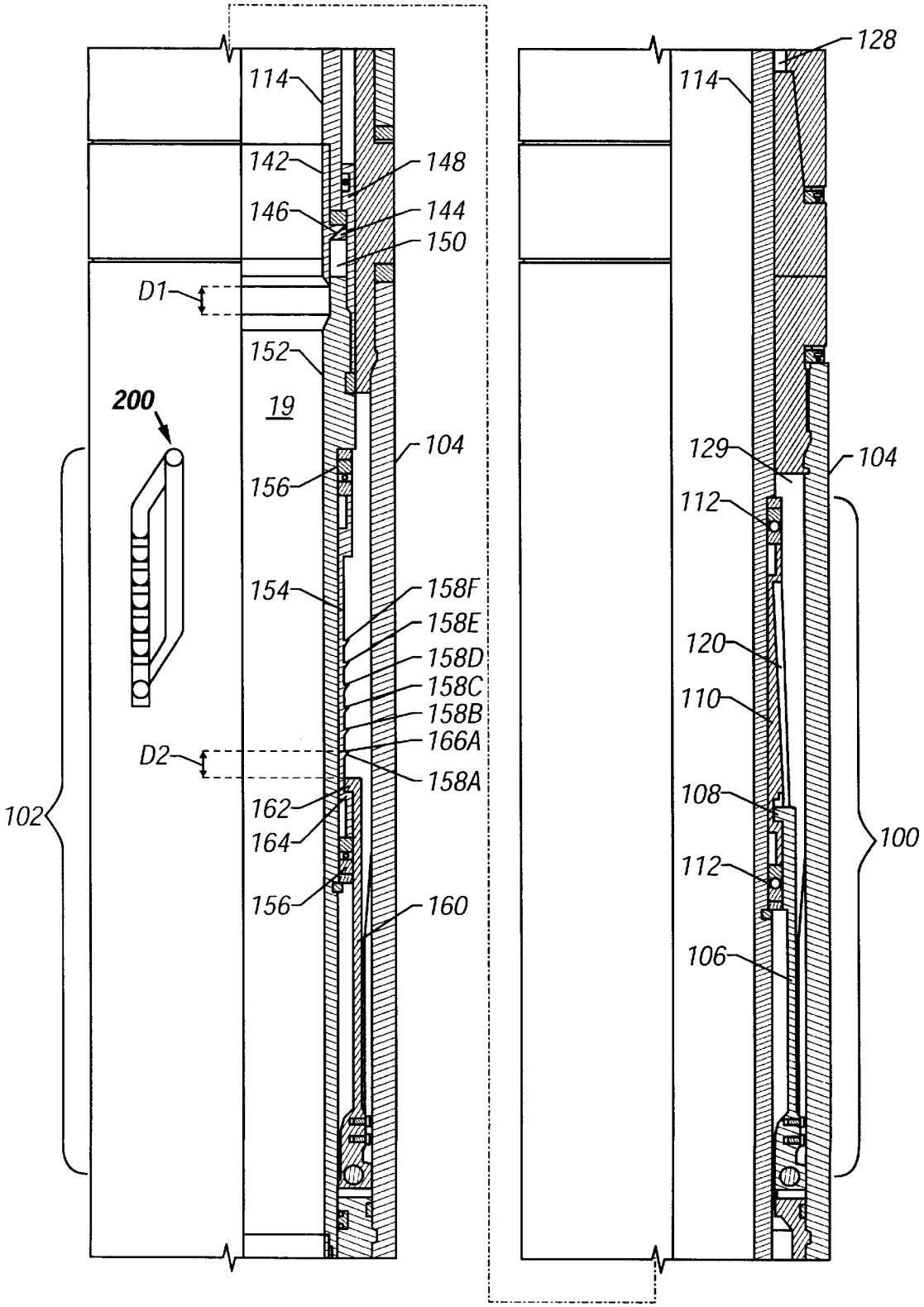
Figure 2C:
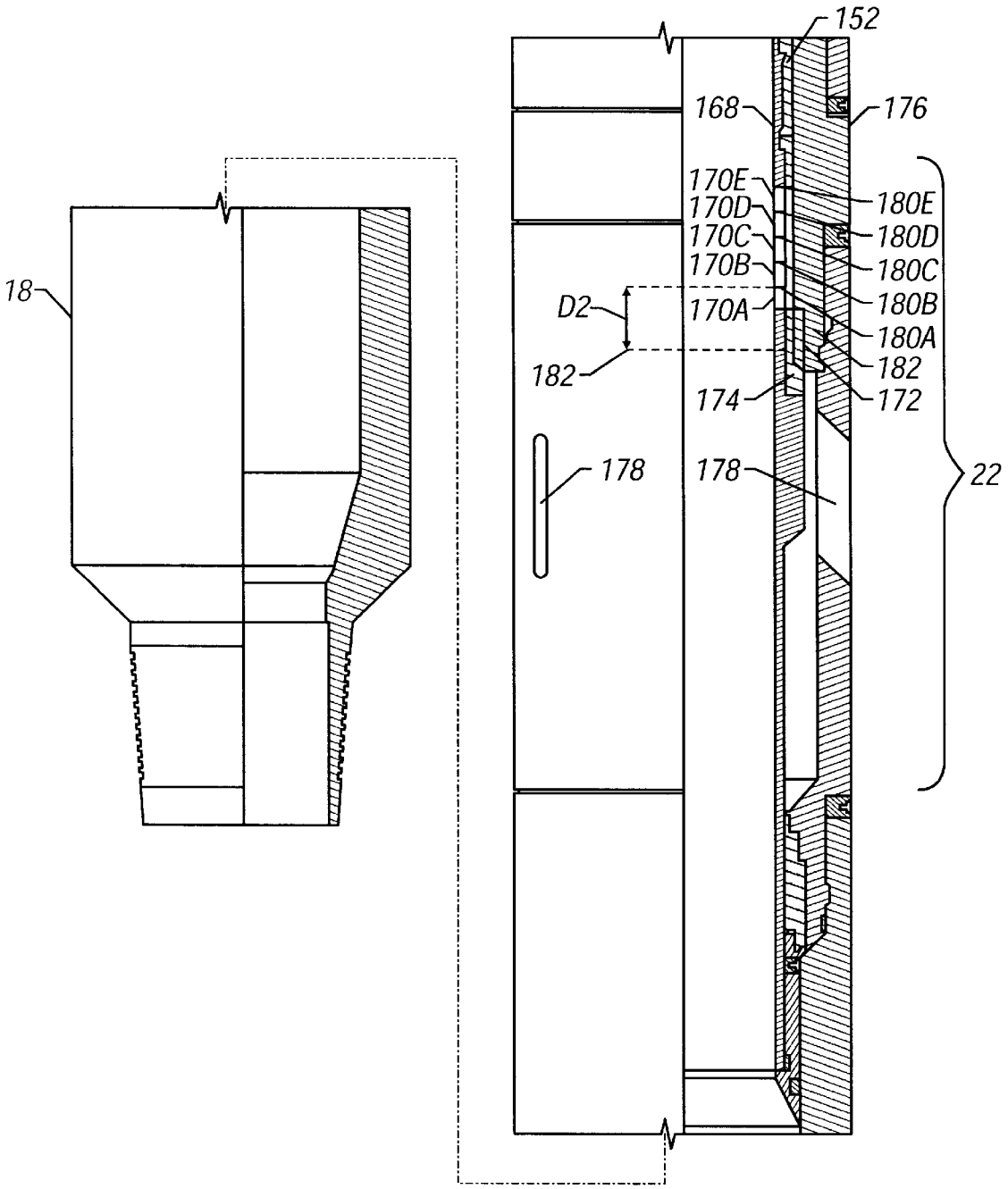

Referring to FIGS. 2A–2C, the valve actuator 26 of the choke system 18 includes an operator mandrel 101 having a first mandrel segment 114 (FIG. 2A) and a second mandrel segment 152 (FIG. 2B). The first mandrel segment 114 is actuatable up and down by fluid pressure applied down a control conduit 122, which may extend from the surface or a region in the well (e.g., casing-tubing annulus). The fluid pressure applied down the conduit 122 flows into an activation chamber 124. Fluid pressure in the activation chamber 124 is applied against an upper surface 125 of a protruding portion 126 of the first mandrel segment 114. On the lower side of the protruding portion 126, the lower surface 127 of the protruding portion 126 is exposed to a balance line chamber 124. The activation chamber 124 is isolated from the balance line chamber 128 by a seal 130. Fluid pressure in the balance line chamber 128 is provided down a conduit 132. In one embodiment, the balance chamber 128 may be filled with oil. Differential pressure created across the protruding portion 126 of the first mandrel segment 114 causes the first mandrel segment 114 to move up or down (a first direction or a second, opposite direction in a deviated or horizontal portion of a well).

In accordance with some embodiments, as illustrated in FIG. 2B, the indexing mechanism 24 is separated into two portions: an indexer device 100 and a positioner device 102. The indexer device 102 includes an indexer finger 106 that is fixably mounted with respect to the housing 104 of the choke system 18. At its upper end, the indexer finger 106 includes an indexer detent 108 that is adapted to run along a pattern of elongated, spaced, and interconnected slots 120

(shown in greater detail in FIG. 3) formed on the outer surface about the circumference of a rotatable indexer sleeve 110 that is part of the indexer device 100. The indexer sleeve 110 is rotatably mounted about the first mandrel segment 114 of the operator mandrel 101 by ball bearings 112 connected at the upper and lower ends of the indexer sleeve 110. In one embodiment, oil or some other suitable fluid is contained in a chamber 129 to maintain lubrication of the ball bearings 112. The arrangement of the pattern of slots 120 allows the first mandrel segment 114 to incrementally actuate or shift downwardly in a predetermined sequence in response to applied fluid pressure cycles in the fluid conduit 122.

The indexer sleeve 110 is made to rotate by downward movement of the first mandrel segment 114 in response to application of fluid pressure. Since the indexer finger 106 is fixably mounted with respect to the housing 104, downward movement of the first mandrel segment 114 causes the indexer sleeve 110 to rotate to allow the indexer detent 108 to run along the indexing slots 120.

The lower end of the first mandrel segment 114 is threadably connected to an actuator member 142 having an outwardly formed flange portion 144. The flange portion 144 extends radially by a sufficient amount so that an outer portion of its upper surface is able to contact a shoulder 146 formed in the inner wall of a connector sleeve 148. The connector sleeve 148 at its lower end is threadably connected to the second mandrel segment 152. Downward movement of the first mandrel segment 114 causes the actuator member 142 to move downwardly so that the flange portion 144 traverses a gap 150. The bottom end of the actuator member 142 traverses a distance D1 to abut an upper surface of the second mandrel segment 152 so that the first mandrel segment 114 can push against the second mandrel segment 152 to cause downward movement of the second mandrel segment 152. The second mandrel segment 152 is moved downwardly by predetermined distances to position the second mandrel segment 152 with respect to increments defined by the positioner device 102. Removal of the applied pressure in the activation chamber 124 allows the first mandrel segment 114 to move upwardly. The gap 150 provides a lost motion separation of the first and second mandrel segments so that upward movement of the first mandrel segment 114 does not cause movement of the second mandrel segment 152 until the flange portion 144 has traveled upwardly across the gap 150. This effectively allows the first mandrel segment 114 to reset after each actuation without causing movement of the second mandrel segment 152. As a result, the positioner device 102 is able to maintain the position of the second mandrel segment 152 to provide substantially precise control of incremental opening of the valve 22 even while the first mandrel segment 114 is moved up and down by application and removal of activation pressures.

The positioner device 102 includes a positioner sleeve 154 having a sawtooth arrangement of a plurality of generally triangular juts or protrusions 158A–158F formed in the outer surface of the positioner device 102. The positioner device 102 is mounted about the second mandrel segment 152 by ball bearings 156 connected to the upper and lower ends of the positioner sleeve 154. The ball bearings 156 allow the positioner sleeve 154 to rotate by a predetermined amount with respect to the second mandrel segment 152 (described further below).

Figure 4:
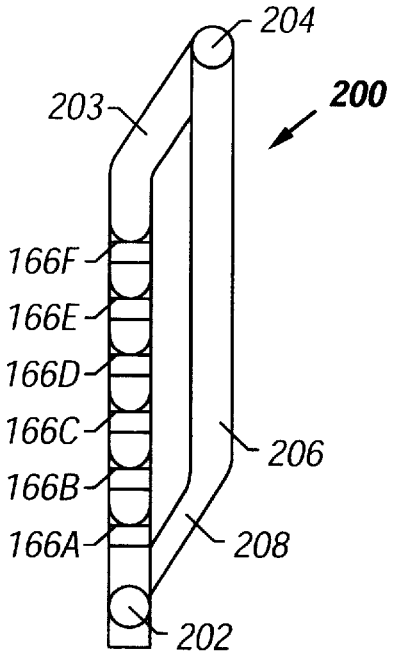
FIG. 4 illustrates the planar view of a positioning pattern formed in a positioner device that is part of the indexing mechanism of FIGS. 2A–2C.

The positioner device 102 includes a positioner finger 160 that is fixably mounted with respect to the housing 104 of the choke system 18. At its upper end, the positioner finger 160 has a positioner detent 162 that is in contact with, or in close proximity to, the outer wall of the positioner sleeve 154. When the second mandrel segment 152 is moved downwardly, the positioner sleeve 154 moves downwardly with it. Initial downward movement of the positioner device 154 by a distance indicated as D2 causes the positioner detent 162 to cross over the first jut 158A so that the lower surface 164 of the positioner detent 162 is in abutment with the upper surface 166A of the first jut 158A. Further downward movement of the second mandrel segment 152 causes the positioner detent 162 to cross over successive juts (158B–158F). Each jut 158 corresponds to an incremental position of the valve 22. The arrangement of the positioning pattern 200 defined in the outer surface of the positioner sleeve 154 is illustrated in FIG. 4, which is described further below. In an alternative embodiment, instead of the use of juts as positioning elements engageable by the positioner detent 162, grooves may be formed in the positioner sleeve 154.

As shown in FIG. 2C, the lower end of the second mandrel segment 152 is threadably attached to a valve mandrel 168 in which an orifice 170 having a series of orifice segments (or discrete increment areas) 170A, 170B, 170C, 170D and 170E is formed. Below the orifice 170 is a seat 174 attached to, or integrally formed in, the outer surface of the valve mandrel 168. The seat 174 is preferably formed of a material having a low coefficient of friction, a high hardness, and that is erosion resistant, such as polycrystalline diamond (PCD) or some other material having these characteristics. Another seat 172 for engagement with the seat 174 is formed on the inner wall of a housing section 176 in the choke system 18. The seat 172 is similarly formed of a material having a low coefficient of friction, high hardness, and that is erosion resistant. In its illustrated position in FIG. 2C (enlarged in FIG. 11), corresponding angled surfaces of the seats 172 and 174 are sealably engaged with each other to provide a closed position of the valve 22. As a result, fluid flowing into the valve 22 through a plurality of openings 178 (formed in the housing of the valve 22) is blocked from the inner bore 19 of the choke system 18. However, downward movement of the valve mandrel 168 (caused by actuation of the operator mandrel 101 including the first and second mandrel segments 114 and 152) causes the seats 172 and 174 to separate so that fluid can start flowing through the orifice 170 between the choke system bore 19 and the zone 16. In one configuration, the flow area of the orifice 170 is incrementally and non-linearly increased as the operator mandrel 101 is shifted or stepped through the plurality of positions defined by the indexing mechanism 24 to provide a predetermined change in flow condition (including pressure drop and/or flow rate) as the valve shifts through the several incremental positions.

Figure 5:
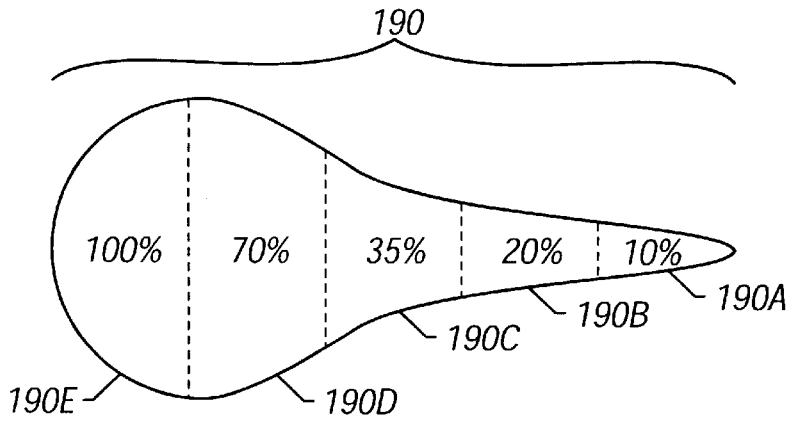
FIGS. 5–10 illustrate orifices according to some embodiments in the valve of FIGS. 2A–2C.
Figure 6:
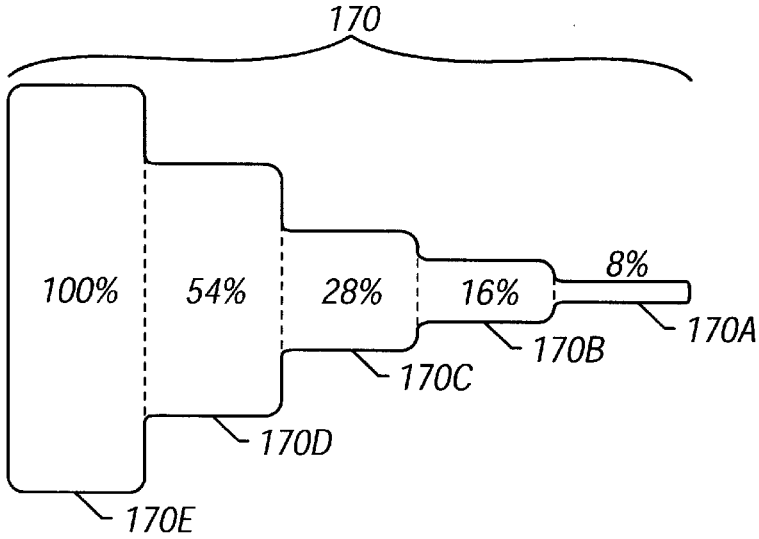
Figure 7:
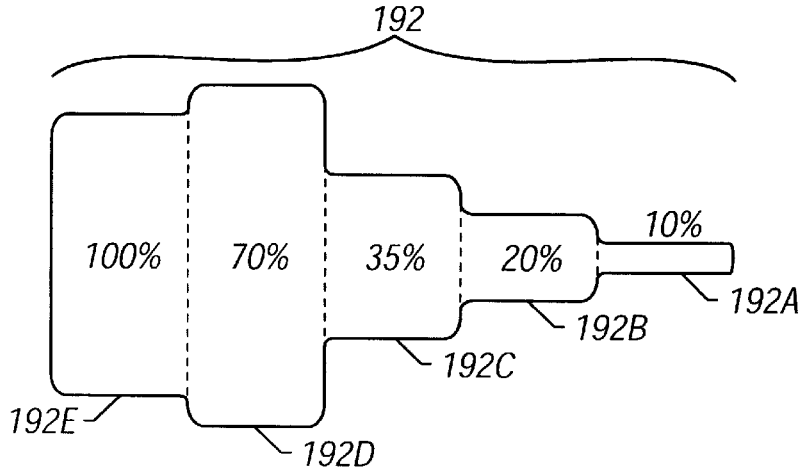
Figure 8:
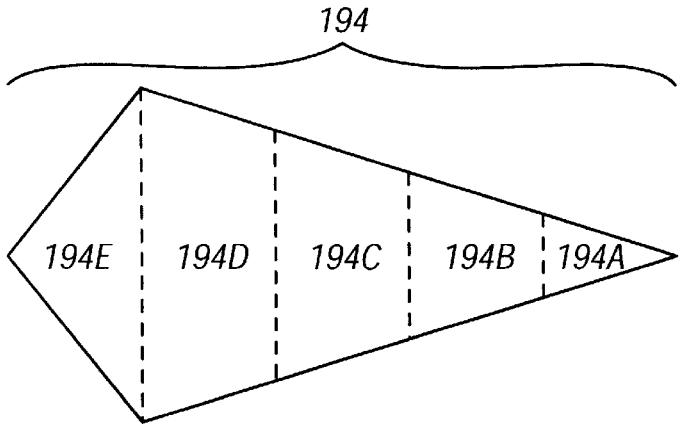

When an edge 180A that defines the boundary between the first orifice segment 170A and the second orifice segment 170B has moved downwardly by the distance D2 to a line indicated generally as 182, the valve 22 is actuated to its first partially open position. Further successive incremental downward movements of the valve mandrel 168 (to line up edges 180B–180E with the line 182) causes further incremental increases in the flow area of the orifice 170. One example arrangement of the orifice 170 is illustrated in FIG. 6, although other arrangements of the orifice may be possible in further embodiments, as illustrated in FIGS. 5, 7 and 8.

Figure 16:
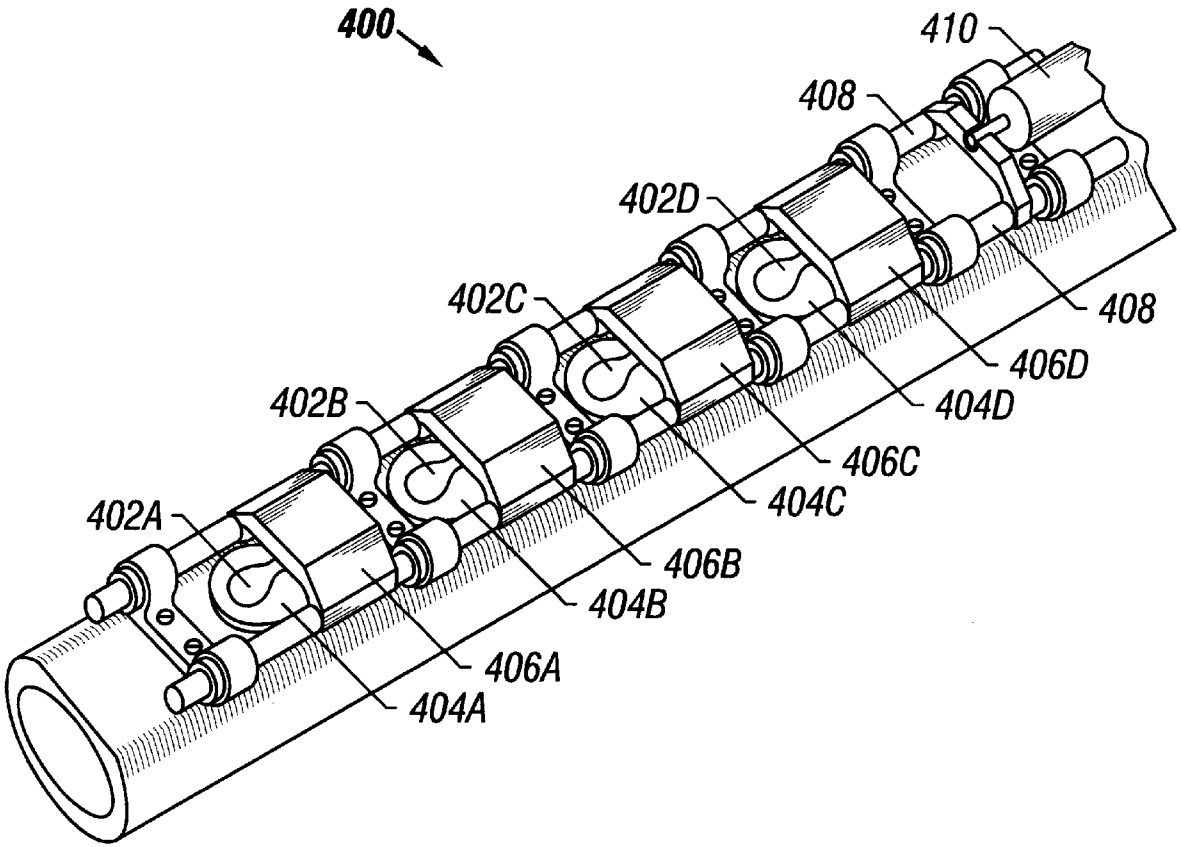
FIG. 16 illustrates a valve in accordance with an alternative embodiment that may be adapted for use in the choke system of FIG. 1.

The seats 172 and 174 in one embodiment are designed to run along the entire inner circumference of the valve housing, which is similar to a sleeve valve. Alternatively, a valve having covers that do not extend around the inner circumference of the valve housing can also be used. One such valve includes any of the valves disclosed in U.S. patent application Ser. No. 09/243,401, entitled "Valves for Use in Wells", referenced above. Such valves have covers that are adapted to slide over an orifice to set the valve at the open, closed, and intermediate positions. An example of such a valve is a valve 400 illustrated in FIG. 16, which has a plurality of generally tear-shaped openings 402A–402D. The openings 402A–402D are formed in respective seats 404A–404D, which may be made of a material having a low coefficient of friction, high hardness, and that is erosion resistant (e.g., PCD). Covers 406A–406D are adapted to be moveable in a longitudinal direction of the valve 400 over respective openings 402A–402D to set the valve at and between open and closed positions. The covers 406A–406D are moveable by rods 408, which are coupled to an actuator 410 that may be operably connected to an indexing mechanism in accordance with some embodiments to position the covers 406A–406D at open, closed, and intermediate positions. Further embodiments of the valve 400 may include fewer or larger numbers of the openings 402. Accordingly, the present invention is useful for virtually any type of valve whether the valve opens by sliding or rotating actuation and variations to the type of valve are considered within the scope of the present invention and are specifically anticipated hereby.

Referring to FIG. 4, the positioning pattern 200 formed in the outer surface of the positioner sleeve 154 is illustrated. The positioning pattern 200 includes a first position 202, which corresponds to the starting position of the positioner detent 162 (which in turn corresponds to the valve 22 being in the closed position). Incremental downward movement of the first mandrel segment 114 and the second mandrel segment 152 as controlled by the indexer device 100 causes the positioner detent 162 to successively cross over the juts 158A–158F to cause the orifice 170 to be set at successive incremental positions. Downward shifting of the valve mandrel 168 (FIG. 2C) exposes successive orifice segments 170A–170F to the openings 178 in the housing of the valve 22. After the orifice 170 has reached its fully open position, the positioner detent 162 next moves along an angled slot 203 to a return position 204. The positioner sleeve 154 is rotated with respect to the second mandrel segment 152 by the amount needed to allow the positioner detent 162 to travel to the return position 204. Once the positioner detent 162 reaches the return position 204, a return slot 206 allows the positioner detent 162 to return to the starting position 202 when the second mandrel segment 114 is moved upwardly. Return of the positioner detent 162 through an angled slot 208 back to the starting position 202 causes the positioner sleeve 154 to rotate back to its original orientation.

Figure 3:
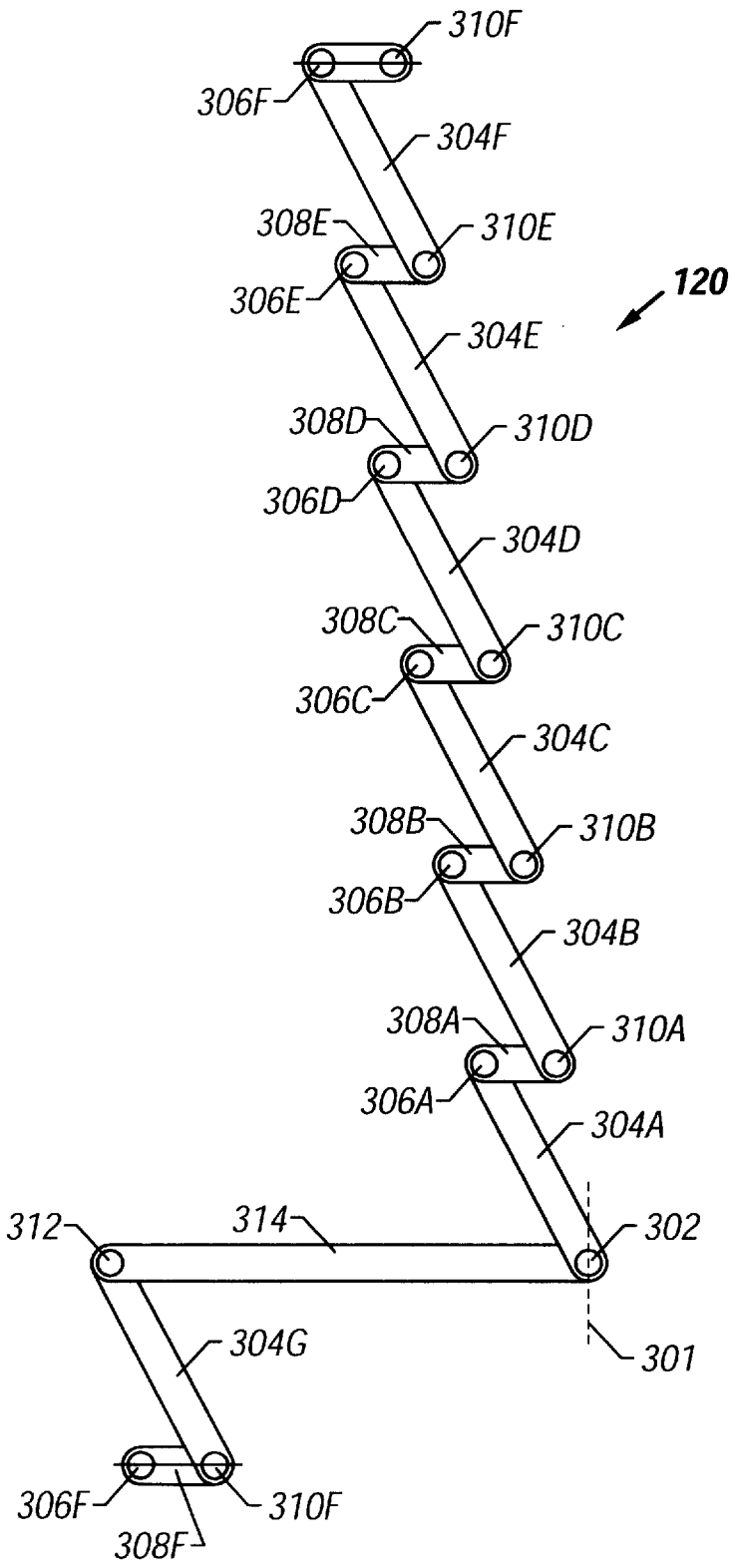
FIG. 3 illustrates the planar view of an indexing pattern formed in an indexer device that is part of the indexing mechanism of FIGS. 2A–2C.

Referring to FIG. 3, the indexing pattern 120 extending circumferentially around the outer surface of the rotatable indexer sleeve 110 is shown in a planar view. The indexing pattern 120 includes a series of slanted, elongated slots 304A–304G that are spaced apart from each other, a plurality of spaced, vertical slots 308A–308F, and a return slot 314 through which the indexer detent 108 can traverse. The indexer detent 108 starts in a first position 302, which corresponds to the closed position of the valve 22.

When the first mandrel segment 114 is actuated downwardly, the indexer sleeve 110 is rotated by an incremental amount to allow the indexer detent 108 to travel along the first angled groove 304A to a first incremental position 306A. Movement of the indexer detent 108 to the incremental position 306A corresponds to the positioner detent 162 in the positioner device 102 crossing over the first jut 158A due to downward movement of the second mandrel segment 152. Removal of the pressure in the activation chamber 124 allows the first mandrel segment 114 to reset by moving upwardly to cause the indexer detent 108 to traverse vertical slot 308A from position 306A to position 310A. Due to the presence of the lost-motion gap 150, the first mandrel segment 114 can move upwardly without pulling the second mandrel segment 152 with it. Thus, the positioner detent 162 of the positioner device 102 is maintained in abutment with the upper shoulder 166A of the first jut 158A while the indexer detent 108 of the indexer device 100 resets. Successive applications and removals of the fluid pressure in the activation chamber 24 causes the indexer detent 162 to successively traverse slanted slots 304B–304G (to increment to successive positions) and vertical slots 308B–308F (to reset). Position 306F corresponds to the fully open position, and a return position 312 is the position from which the indexer detent 108 can return to the starting position 302 through return slot 314. In successive actuations of the first mandrel segment 114 to successive incremental positions by the indexer device 100, the positioner detent 162 is maintained in abutment with a corresponding positioning jut 158 while the indexer device 102 resets. As a result, the positioner device 100 is able to maintain the incremental position of the second mandrel segment 152 to provide substantially precise control of the position of the valve 22.

From the return position 312 in the indexing pattern 120, the indexer detent 108 can traverse the return slot 314 back to the starting position 302, which allows the first mandrel segment 114 to move upwardly (along with the indexer sleeve 110) to return the indexing mechanism 24 to its starting position, which corresponds to the closed position of the valve 22. The upward movement of the first mandrel segment 114 during the return causes the second mandrel segment 152 to move upwardly by about the same distance. Upward movement of the second mandrel segment 152 is achieved by the upper surface of the flange portion 144 (FIG. 2B) pulling upwardly on the shoulder 146 of the connector sleeve 148. The upward movement of the second mandrel segment 152 allows the positioner detent 162 to move along the return slot 206 (FIG. 4) back to its starting position 202 in the positioner sleeve 154.

Figure 11:
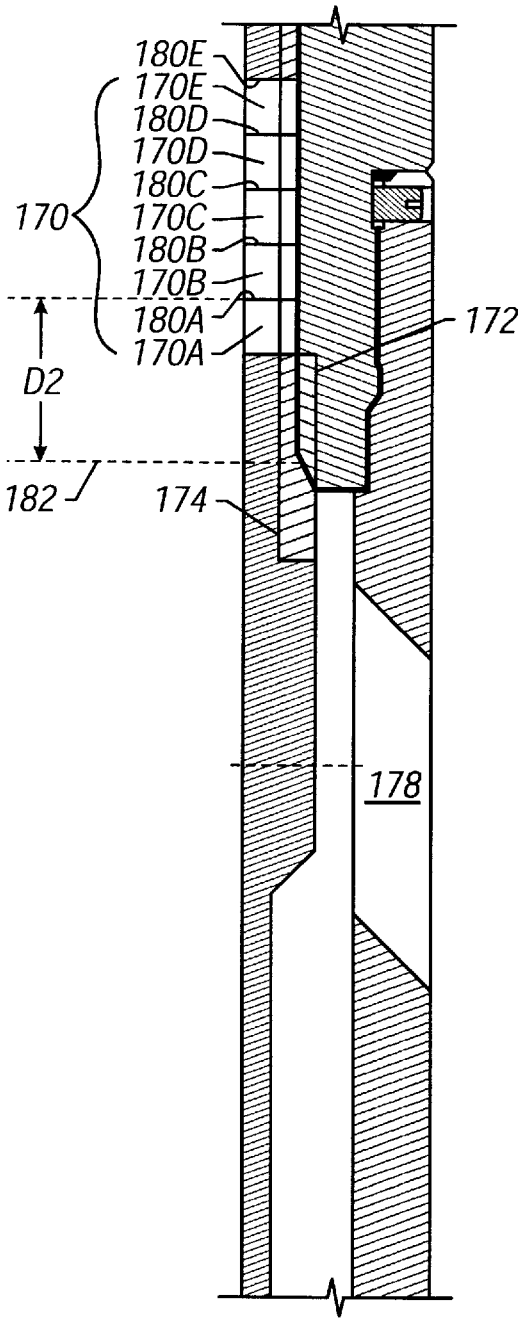
FIG. 11 is an enlarged cross-sectional view of a portion of the valve of FIGS. 2A–2C.

In operation, the valve 22 is actuated from its closed position by successive applications of fluid pressure in the activation chamber 124 (FIG. 2A). Depending on the desired flow rate (for injection or production), the orifice 170 in the valve 22 can be set at any one of the incremental positions, including the closed position, an intermediate position, and the open position. From the closed position, the first application of fluid pressure causes the first mandrel segment 114 to move downwardly until the lower end of the actuator member 142 contacts and pushes against the upper end of the second mandrel segment 152. Further downward movement of the first mandrel segment 114 moves the second mandrel segment 152 downwardly. When the second mandrel segment 152 has moved by a predetermined distance, the positioner detent 162 crosses over the first positioning jut 158A to provide the first incremental position of the second mandrel segment 152. This corresponds to the first incremental position of the orifice 170 in the valve 22, in which the edge 180A between the first and second orifice segments 170A and 170B is generally lined up with a line 182 (FIGS. 2C and 11). To reset the first mandrel segment 114, pressure in the activation chamber 124 is removed, which causes the first mandrel segment 114 to move upwardly. However, due to presence of the lost motion gap 150 (FIG. 2B), the flange portion 144 of the actuator member 142 is able to move some distance upwardly without corresponding upward movement of the second mandrel segment 152. The distance provided by the lost motion gap 150 is the same as the distance of each vertical slot 308 in the indexing pattern 120 of the indexer device 100. A subsequent application of fluid pressure in the activation chamber 124 again actuates the first mandrel segment 114 downwardly to push the second mandrel segment 152 downwardly by some distance. This causes the positioner detent 162 to cross over the second positioning jut 158B, which corresponds to the second incremental position of the orifice 170 (in which the edge 180B between orifice segments 170B and 170C is lined up with the line 182). Pressure is then removed from the activation chamber 124 to reset the first mandrel segment 114. Further applications and removals of the fluid pressure in the activation chamber 124 can be made to set the orifice 170 at further incremental positions. Once fully opened, the next fluid pressure cycle causes the indexing mechanism 24 (including the indexer device 100 and the positioner device 102) to return to its original position, which corresponds to the closed position of the orifice 170 in the valve 22.

Referring to FIGS. 5–10 various different embodiments of the valve orifices are illustrated. In FIG. 5, a generally tear-shaped orifice 190 is illustrated that has segments 190A–190F. As illustrated, the first partial open position (including orifice segment 190A) provides a 10% opening (that is, the flow area is 10% of the total available flow area provided by the orifice 190). In the second partial open position (including orifice segment 190A and 190B), the flow area is increased by another 10% to provide a 20% open flow area. In the next partial open position (including orifice segments 190A–190C), the flow area is increased by 15% to provide a 35% open flow area. The next incremental position provides an increase of 35% in the open area to achieve a tot al open area of 70%. Finally, the next incremental position provides a fully open position (100%).

In FIG. 6, instead of the generally tear-shaped configuration of the orifice 190, a series of orifice segments 170A–170F are provided in sequence. The first rectangular segment 170A is the narrowest, while the last rectangular 170E is the widest. The partial open flow area provided by the first flow orifice is 8% of the total available flow area. The next incremental position provides an additional flow area of 8% to provide a 16% open flow area, followed by 28%, 54%, and 100%.

Referring to FIG. 7, a variation of the configuration shown in FIG. 6 is illustrated. In the orifice 192 of FIG. 7, five segments 192A–192E of varying widths are provided. However, in the FIG. 7 configuration, the segment 192D is widest. The first segment 194A provides a flow area of 10%, followed by incremental increases to 20%, 35%, 70%, and 100%.

In the embodiments of FIGS. 5–7, each of the orifices has a width that varies from relatively narrow proximal a first end to relatively wide proximal a second end. However, in FIG. 8, another embodiment provides a generally diamond shaped orifice 194 including segments 194A–194E. In this arrangement, the incremental changes in flow area increase and then decrease after crossing through the segment 194D.

In addition to the specific values of flow areas listed above for the several incremental positions, the following are ranges of flow areas that may be possible at different valve positions: the closed position may have a flow area between about 0 and about 6% of the total available flow area; a first incremental position may have a flow area between about 7% and about 13%; a second incremental position may have a flow area between about 14% and about 23%; a third incremental position may have a flow area between about 24% and about 43%; a fourth incremental position may have a flow area between about 44% and about 95%; and a fifth incremental position (which is the open position) may have a flow area between about 95% and about 100%.

Figure 9:
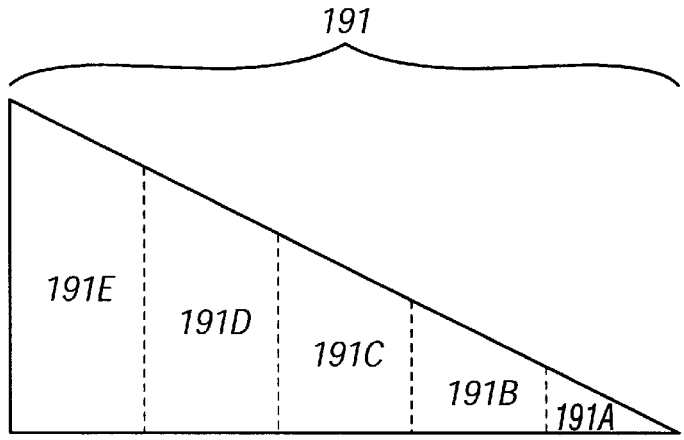
Figure 10:
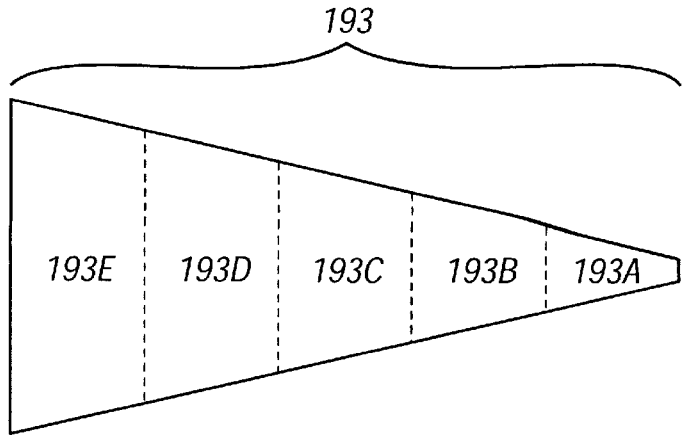

Referring further to FIGS. 9 and 10, a generally triangular-shaped orifice 191 having segments 191A–191E and a generally trapezoidal orifice 193 having segments 193A–193E are illustrated. Other configurations of the valve orifice are also possible, and depends on the desired change in flow condition as the valve shifts through its incremental positions.

As seen in FIGS. 5–8, the change in flow area between incremental positions of each orifice is non-linear to provide a predetermined change in flow condition. This provides more flexible control of the flow condition of the valve 22. Thus, if desired, the change in pressure drop and flow rate can be maintained substantially the same as the valve 22 is incrementally opened. Other predetermined changes in the flow condition of the valve 22 can also be achieved.

In the embodiments shown in FIGS. 2A–2C and 5–10, the stroke length of the valve actuator 26 as defined by the indexing mechanism 24 is about the same as the actuator 26 shifts or steps through the several incremental positions. In such embodiments, the non-linear change in flow area is achieved by generally non-uniformly shaped orifice segments, as seen in FIGS. 5–8, while the stroke length between incremental positions of the valve actuator is maintained about the same.

Figure 12:
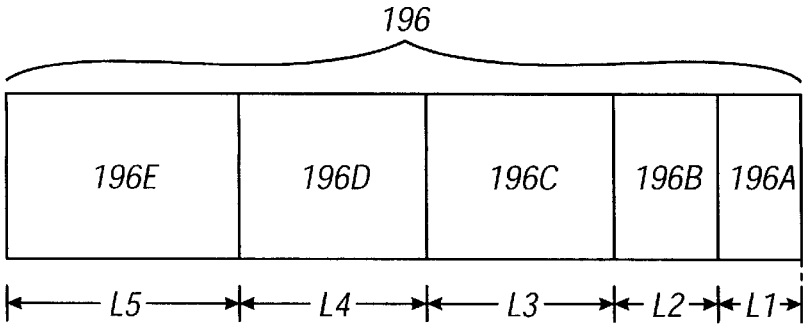
FIGS. 12–13 illustrate orifices according to some other embodiments in the valve of FIGS. 2A–2C.
Figure 13:
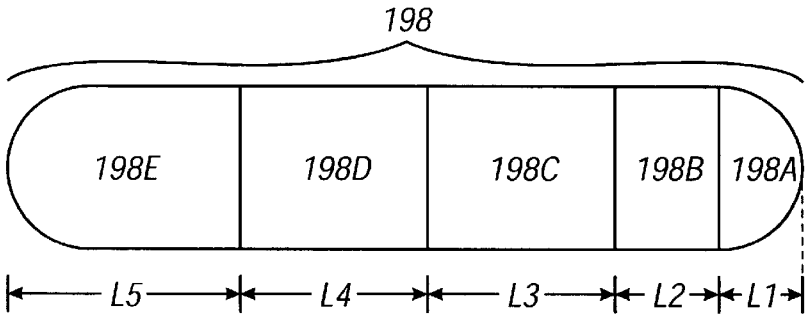
Figure 14:
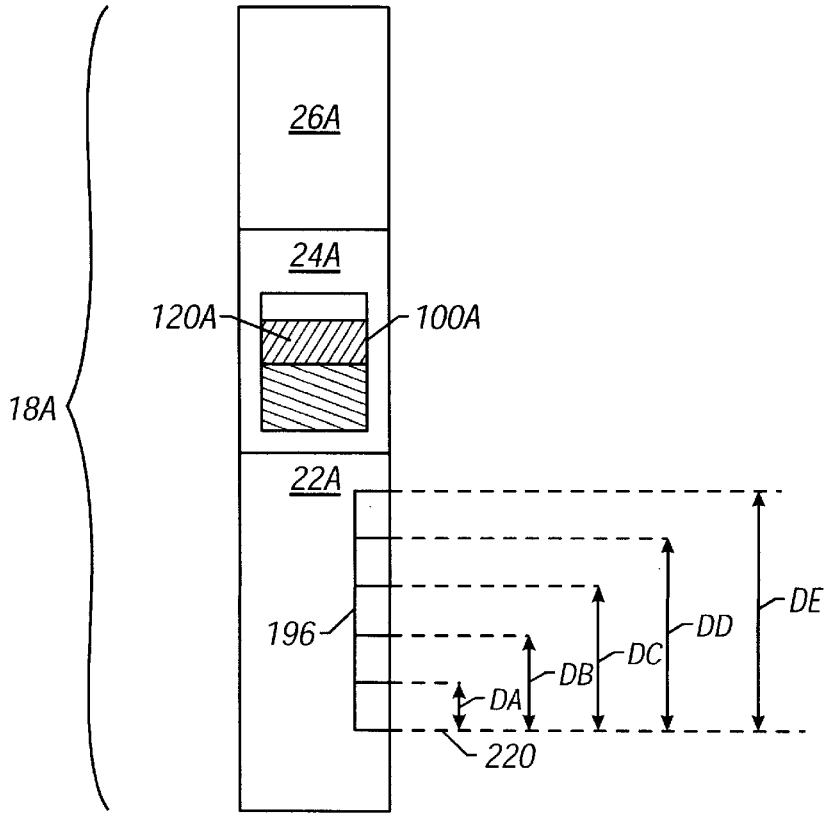
FIG. 14 is a schematic diagram of a choke system according to alternative embodiments.
Figure 15:
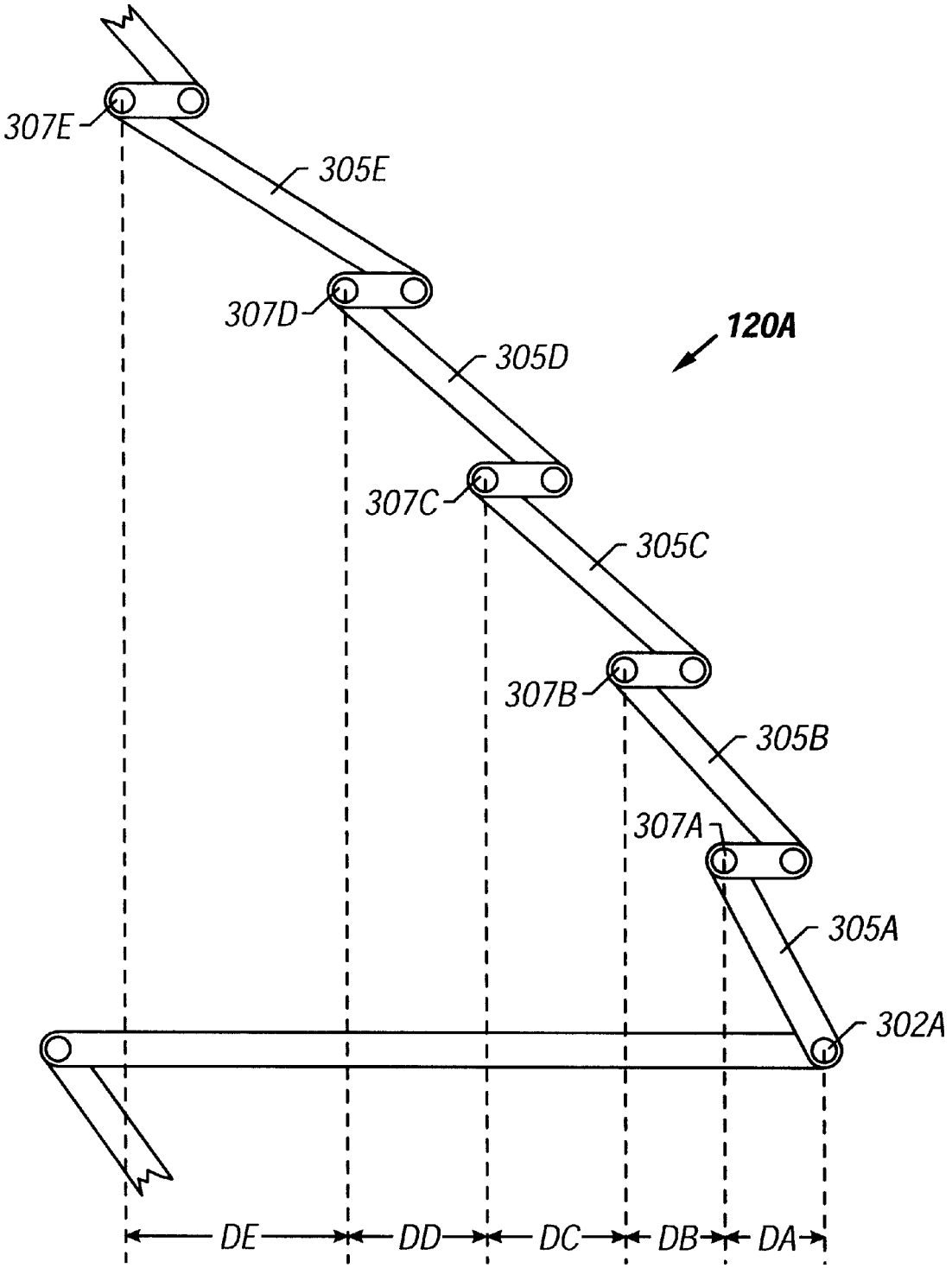
FIG. 15 illustrates an indexing mechanism for use in the choke system of FIG. 14.

In alternative embodiments, more uniformly shaped orifices may be used and flow area of an orifice can be made to vary non-linearly by varying the stroke length of the valve actuator. Thus, for example, as seen in FIGS. 10 and 11, orifices 196 and 198 are illustrated, respectively. The orifice 196 is generally rectangular in shape, and includes orifice segments 196A–196E. The length of the segments 196A, 196B, 196C, 196D, and 196E may be different, as indicated by L1, L2, L3, L4, and L5, respectively. Referring to FIG. 12, to provide control of the change of the flow area in the orifice 196 in accordance with the alternative embodiments in a choke system 18A, the stroke lengths of a valve actuator 26A are different between incremental positions. This is achieved by modifying the design of an indexing mechanism 24A that includes an indexer device 100A. In the indexer device 100A, an indexing pattern 120A (FIG. 15) may be changed so that movement to the different positions defined by the slots in the indexing pattern 120A provides different stroke lengths of the actuator 26A. The plurality of slots in the indexing pattern 120A define incremental positions of a valve 22A containing the orifice 196. A baseline 220 is defined, which corresponds to the closed position of the orifice 196. The incremental positions of the orifice 196 are at varying distances from baseline 220, and the differences in the distances (DA, DB, DC, DD, and DE) from the baseline 220 between the incremental positions vary non-linearly. In one embodiment, the distances DA–DE can be sequentially increasing. The stroke lengths of the valve actuator 26A may be made to correspond to the distances DA–DE so that the stroke lengths also vary non-linearly (e.g., sequentially increasing in one embodiment). As illustrated in FIG. 15, an indexer detent that is engaged and moveable in the indexing slot pattern 120A starts at position 302A (closed position of the valve) and moves through slanted slots 305A, 305B, 305C, 305D, and 305E to positions 307A, 307B, 307C, 307D, and 307E. The differences in stroke lengths may be achieved by varying the angle of the slanted slots 305 so that the distances (DA, DB, DC, DD, DE) between adjacent positions 307 are different. In FIG. 11, an alternative orifice 198 is illustrated that may be employed in the valve 22A. The orifice 198 has generally curved ends and includes segments 198A–198E. As with the orifice 196 of FIG. 10, the lengths L1–L5 of respective segments 198A–198E are different. In the alternative embodiments of FIGS. 10 and 11, the change in flow area between incremental positions is made to be non-linear to provide flexible control of the flow condition of the valve 22 so that a predetermined change or changes in flow condition may be provided as the valve 22 is sequenced through the several incremental positions.

The method and apparatus to non-linearly vary the flow area of a valve orifice between several incremental positions is independent of the method and apparatus to provide substantially precise control of the valve incremental positions. Some embodiments may include the former feature but not the latter and vice versa. For example, in embodiments having the substantially precise control feature, the indexing mechanism and shape of the valve orifice may be designed to provide substantially linear variations in flow area as the valve orifice is shifted or stepped through the several incremental positions. In embodiments having the ability to vary the flow area of the valve orifice non-linearly to provide a predetermined change in flow condition of the valve, an indexing mechanism that is not separated into two portions as discussed in relation to FIGS. 2–4 may be employed.

While the foregoing is directed to the preferred embodiment of the present invention, other and further embodiments of the invention may be devised without departing from the basic scope thereof, and the scope thereof is determined by the claims which follow. It is the express intention of the applicant not to invoke 35 U.S.C. § 112, paragraph 6 for any limitations of any of the claims herein, except for those in which the claim expressly uses the word "means" together with an associated function.

We claim:

1. A choke system for use in a well, comprising:

a valve having an orifice through which well fluid flow can be choked;

an actuator adapted to position the valve at one or more incremental positions between an open position and a closed position; and the valve, the orifice, and the actuator adapted to provide a predetermined change in well flow condition when the actuator moves the valve between a first pair of positions and to provide substantially the predetermined change in flow condition when the actuator moves the valve between a second pair of positions, wherein the predetermined change in flow condition comprises a predetermined change in pressure.

2. The system of claim 1, further comprising:

an indexing mechanism attached to the actuator, the indexing mechanism adapted to shift movement of the actuator through the one or more incremental positions, the open position, and the closed position.

3. The system of claim 1, further comprising:

the valve and the orifice defining a flow area; and the flow area increasing nonlinearly as the valve moves from the closed position through the one or more incremental positions to the open position.

4. The system of claim 3, further comprising:

the orifice having a total area;

the flow area at the closed position having a cross sectional area between about zero and about six percent of the total area of the orifice;

the flow area at a first incremental position having a cross sectional area between about seven and about thirteen percent of the total area of the orifice;

the flow area at a second incremental position having a cross sectional area between about fourteen and about twenty-three percent of the total area of the orifice;

the flow area at a third incremental position having a cross sectional area between about twenty-four and about forty-three percent of the total area of the orifice;

the flow area at a fourth incremental position having a cross sectional area between about forty-four and about ninety five percent of the total area of the orifice; and the flow area at the opened position having a cross sectional area between about ninety-five and about one hundred percent of the total area of the orifice.

5. The system of claim 4, further comprising:

at least one additional incremental position between the opened and closed positions.

6. The system of claim 1, further comprising:

the orifice having a generally tear-drop shape.

7. The system of claim 1, further comprising:

the orifice defining a plurality of discrete increment areas;

the plurality of discrete increment areas having substantially the same length; and the plurality of discrete increment areas each having an area selected to increase the flow area of the orifice by a predetermined amount to provide a substantially consistent change in the pressure drop between different valve positions.

8. The system of claim 1, further comprising:

the orifice having a width that varies from relatively narrow proximal a first end to relatively wide proximal a second end.

9. The system of claim 1, further comprising:

the orifice having generally a triangular shape.

10. The system of claim 1, further comprising:

the orifice having generally a trapezoidal shape.

11. The system of claim 1, further comprising:

the orifice having generally a diamond shape.

12. The system of claim 1, wherein each of the first and second pairs of positions comprises two of the open position, closed position, and one or more incremental positions.

13. A choke system comprising:

a valve having an orifice through which well fluid flow can be choked;

an actuator adapted to position the valve at one or more incremental positions between an open position and a closed position; and the valve, the orifice, and the actuator adapted to provide a predetermined change in flow condition between different valve positions; and an indexing mechanism attached to the actuator, the indexing mechanism adapted to shift movement of the actuator through the one or more incremental positions, the open position, and the closed position, wherein the indexing mechanism further comprises:

a first indexer member defining a plurality of elongated, spaced, interconnected slots;

a second indexer member having a detent attached thereto, the detent adapted to mate with and move within the plurality of slots;

at least one of the first and second indexer members adapted for movement relative to the other;

the plurality of slots and the detent adapted to cooperatively restrict the relative movement of the first and second indexer members;

the plurality of slots defining incremental positions at varying distances from a baseline; and the differences in the distances from the baseline between the plurality of slots vary nonlinearly.

14. The system of claim 13, further comprising:

the differences in the distances from the baseline for adjacent pairs of the plurality of slots increase nonlinearly.

15. The system of claim 13, further comprising:

the difference in the distances from the baseline for adjacent pairs of the plurality of slots sequentially increases.

at least one additional incremental position between the opened and closed positions.

16. A valve assembly comprising:

a valve;

an actuator moveable to a plurality of positions to actuate the valve between a plurality of incremental positions comprising an open position, a closed position, and at least one intermediate position; and a mechanism having an indexer device and a positioner device, the indexer device cooperable with the actuator to step the actuator through the plurality of positions, and the positioner device adapted to maintain the position of at least a first portion of the actuator after each step of the actuator, the positioner device having a lost motion element to enable the indexer device to reset without affecting the position of the valve.

17. The valve assembly of claim 16, wherein the actuator first portion is operably coupled to the valve so that movement of the actuator first portion causes a change in position in the valve.

18. The valve assembly of claim 16, wherein the indexer device includes a plurality of interconnected slots and a detent moveable in the slots, the detent and the plurality of slots defining the plurality of positions of the actuator.

19. A valve assembly comprising:

a valve;

an actuator moveable to a plurality of positions to actuate the valve; and a mechanism having an indexer device and a positioner device, the indexer device cooperable with the actuator to step the actuator through the plurality of positions, and the positioner device adapted to maintain the position of at least a first portion of the actuator after each step of the actuator to provide substantially precise control of the valve, wherein the indexer device includes a plurality of interconnected slots and a detent moveable in the slots, the detent and the plurality of slots defining the plurality of positions of the actuator, and wherein the positioner device includes a sequence of positioning elements and a detent sequentially engageable with the positioning elements, the detent and positioning elements defining the position of the actuator first portion.

20. The valve assembly of claim 19, wherein the actuator further has a second portion actuatable by fluid pressure, the actuator second portion adapted to engage the actuator first portion to move the actuator first portion.

21. The valve assembly of claim 20, wherein the plurality of slots in the indexer device and the detent define successive positions of the second actuator portion.

22. The valve assembly of claim 21, wherein the actuator first and second portions are operatively attached by a connector device having a lost motion gap to allow the actuator second portion to reset without moving the actuator first portion.

23. The valve assembly of claim 22, wherein the actuator second portion is reset by reduction of the fluid pressure.

24. A choke system comprising:

a valve having an orifice;

an actuator to position the valve at a plurality of incremental positions including a closed position, an open position, and one or more intermediate positions, the orifice defining a flow area at each of the incremental positions, the flow areas being selected to vary to provide a predetermined change in a flow condition of the valve; and an indexing mechanism having an indexer device to step the actuator through the incremental positions and a positioner device to maintain the position of the valve after each step of the actuators, the positioner device enabling the indexer device to reset after each step without moving the valve.

25. A choke system for use in a well, comprising:

a valve having an orifice through which well fluid flow can be choked;

an actuator adapted to position the valve at one or more incremental positions between an open position and a closed position; and the valve, the orifice, and the actuator adapted to provide a predetermined change in well flow condition when the actuator moves the valve between a first pair of positions and to provide substantially the predetermined change in flow condition when the actuator moves the valve between a second pair of positions, wherein the predetermined change in flow condition comprises a predetermined change in flow rate.

26. A method for choking the flow through an orifice using an actuator attached to a valve, the valve positionable at a plurality of incremental positions between an open position and a closed position, the method comprising:

moving the valve between a first pair of adjacent positions;

moving the valve between a second pair of adjacent position; and maintaining a predetermined change in a flow condition of the valve when the valve is moved between the first pair of adjacent positions and between the second pair of adjacent positions, wherein the predetermined change in flow condition comprises a predetermined change in pressure.

27. The method of claim 26, wherein the maintaining including non-linearly varying a flow area of the valve corresponding to the incremental positions.

28. The method of claim 27, further comprising defining an orifice in the valve having a plurality of segments of varying flow areas and actuating the valve to successively expose the orifice segments as the valve shifts through the incremental positions.

29. The method of claim 27, further comprising changing stroke lengths of an actuator operably coupled to the valve as the actuator is moved through incremental steps to provide the incremental positions of the valve.

30. A method for choking the flow through an orifice using an actuator attached to a valve, the valve positionable at a plurality of incremental positions between an open position and a closed position, the method comprising:

moving the valve between a first pair of adjacent positions;

moving the valve between a second pair of adjacent position; and maintaining a predetermined change in a flow condition of the valve when the valve is moved between the first pair of adjacent positions and between the second pair of adjacent positions, wherein the predetermined change in flow condition comprises a predetermined change in flow rate.

* * * * *